United States Patent [19]

Guiler

[11] 4,296,616

[45] Oct. 27, 1981

[54] ADAPTOR FOR PLUNGER LOCK OPERATING TOOL

[75] Inventor: Richard S. Guiler, Stewartsville, N.J.

[73] Assignee: E. J. Brooks Company, Newark, N.J.

[21] Appl. No.: 75,849

[22] Filed: Sep. 14, 1979

[51] Int. Cl.[3] ..... E05B 67/36

[52] U.S. Cl. ..... 70/34; 70/395

[58] Field of Search ..... 70/34, 32, 33, 395, 70/386

[56] References Cited

U.S. PATENT DOCUMENTS

| | | | |
|---|---|---|---|
| 4,040,279 | 8/1977 | Signorelli | 70/34 |
| 4,058,992 | 11/1977 | Nielsen | 70/34 |
| 4,155,232 | 5/1979 | Haus | 70/34 |

*Primary Examiner*—Robert L. Wolfe

*Attorney, Agent, or Firm*—Robert E. Ross

[57] ABSTRACT

An adaptor for attachment to a plunger lock unlocking tool of a type which grasps the external surface of the unlocking pin of a plunger-type lock and pulls the pin to the unlocking position, said adaptor enabling the tool to be used to unlock a plunger lock of the type in which the unlocking member is a hollow pin which is grasped internally for pulling to the unlocking position.

6 Claims, 4 Drawing Figures

ADAPTOR FOR PLUNGER LOCK OPERATING TOOL

BACKGROUND OF THE INVENTION

So-called plunger type locks are commonly used in the utility industry to lock gas valves, meter housing and the like. Such locks have an unlocking plunger recessed within a housing, said plunger being normally biased to the locking position, and may be pulled by a suitable tool or "key" to the unlocking position.

One type of plunger lock that has been widely used is illustrated in U.S. Pat. No. 3,186,196, issued June 1, 1965. In the lock disclosed therein, the end of the plunger is formed to provide a hollow pin, recessed in a housing opening, as the unlocking member. The pin is biased away from the housing opening to the unlocking position, and may be pulled toward the opening to an unlocking position. The pin is pulled to the unlocking position by a suitable tool, commonly called a "key" which has an elongated mechanism for inserting through the opening into the hollow pin. Movement of an operating handle on the tool causes longitudinal movement of one portion of the elongated mechanism in relation to the other portion, causing a lateral spreading of the end of the mechanism, which thereby frictionally engages the inside of the hollow pin. Thus rearward movement of the mechanism causes the pin to move rearwardly to the unlocking position. One form of such expandable mechanism is shown in the above-mentioned U.S. Pat. No. 3,186,196, and another form is shown in U.S. Pat. No. 3,446,045, issued May 27, 1969.

However, a plunger lock with a new form of pin has begun to achieve commercial success. This new type of lock utilizes a solid pin on the end of the plunger as the unlocking member, and a tool is provided that grasps the external surface of the pin for pulling the pin to the unlocking position.

A lock having this structure is shown in U.S. Pat. No. 4,015,456, issued Apr. 5, 1977, and one form of tool that may be used with this type of pin is shown in U.S. Pat. No. 4,058,992 issued Nov. 22, 1977.

It has been found that utilities that already use substantial quantities of the plunger lock with the hollow pin are reluctant to purchase the new type of lock with the solid pin, since they would then have to equip their employees with a new type of key to operate the new type of lock, and the employees would have to carry both types of keys in servicing meters or in locking and unlocking valves.

SUMMARY OF THE INVENTION

This invention provides an adaptor for mounting onto a plunger lock operating tool of the type which is adapted for externally grasping a solid unlocking pin of a plunger lock, to enable the tool to be used to unlock a plunger lock having a hollow operating pin which must be grasped internally for pulling to the unlocking position.

The adaptor comprises a housing with means on the rear end for mounting onto the operating end of the plunger lock tool. An operating mechanism extends forwardly from the housing, comprising an operating rod for entry into the hollow pin of a plunger lock, said rod having an enlarged end and being surrounded by a sleeve with outwardly flexible end portions. Movement of the rod inwardly causes the enlarged end to expand the end of the sleeve.

Means is provided inside the housing for being gripped and pulled by the operating mechanism of the tool onto which the adaptor is assembled, to cause the operating rod to move into the sleeve and thereby grip the inner surface of the hollow pin, whereby the pin can be pulled to the unlocking position.

Means is also provided for limiting the movement of the operating member in relation to the sleeve to prevent permanent deformation of the flexible end portions, and to cause the entire operating member and sleeve assembly, after said initial movement, to thereafter move into the housing together to move the operating pin of the plunger lock to the unlocking position.

BRIEF DESCRIPTION OF THE DRAWINGS

FIG. 5 is a view of a portion of the assembly of FIG. 2 in position for unlocking a plunger lock of the type which has a hollow operating pin adapted to be grasped internally.

DESCRIPTION OF THE ILLUSTRATED EMBODIMENT

Figure 1:
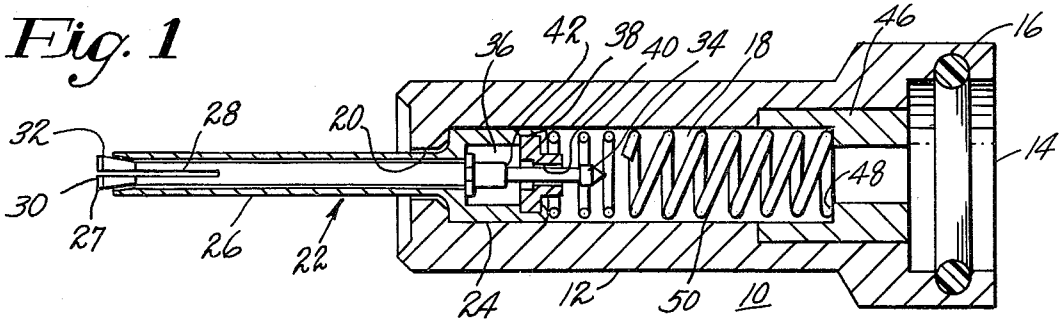
FIG. 1 is a view in side elevation, partly in section, of an adaptor embodying the features of the invention.

Referring to FIG. 1 of the drawing there is illustrated an adaptor 10 which comprises a housing 12 having an opening 14 at the rear end with an internal resilient ring 16 for frictionally engaging the nose of a tool of a type to be described hereinafter.

The housing opening 14 leads to an internal cavity 18. Assembled into the cavity 18 and protruding from a forward opening 20 is an operating mechanism 22 which is movable in relation to the housing as will be described. The mechanism 22 comprises an outer member comprising a body 24 disposed in the cavity 18 and a sleeve 26 extending therefrom through the opening 20 and projecting forwardly from the housing, the end of said sleeve being formed into resilient segments 27.

Disposed within the sleeve 26 and extending through the body 24 and rearwardly therefrom is an operating rod 28 having an enlarged head 30 with a cam surface 32 on the forward end outside of the end of the sleeve.

The rear end of the rod projects rearwardly of the body 24, and has an enlarged rearmost portion 34 to facilitate grasping by a pulling tool as will appear hereinafter.

The rod 28 is capable of longitudinal movement in the sleeve 26. To limit the amount of such movement, and to cause retraction of the rod and sleeve together after such limited movement, the body 24 is provided with an internal cavity 36. The rear end of the cavity is closed by a bushing 38 which has a central aperture 40. The rear end of the rod extends through the aperture 40. Within the cavity 36, the rod has a rearwardly facing stop shoulder 42, which limits rearward movement of the rod in relation to the sleeve by contacting the bushing 38.

A bushing 46 is mounted at the rear end of the housing cavity 18 dimensioned to provide a stop 48 at the forward end thereof in the cavity 18 and a spring 50 is disposed in the cavity between the bushing stop 48 and the body 24, thereby biasing the body 24 and sleeve 26 forwardly.

The spring 50 has sufficient biasing force against the body 24 that on rearward movement of the operating rod 28, the rod first moves rearwardly in relation to the sleeve 26, with the head 30 of the rod moving back into the forward end of the sleeve, expanding the segments 27, until the stop 42 on the rod encounters the bushing 38.

Further rearward movement of the operating rod 28 (by the tool to be described) causes rearward movement of the body 24, compressing the spring 50, for purposes to be described.

Figure 2:
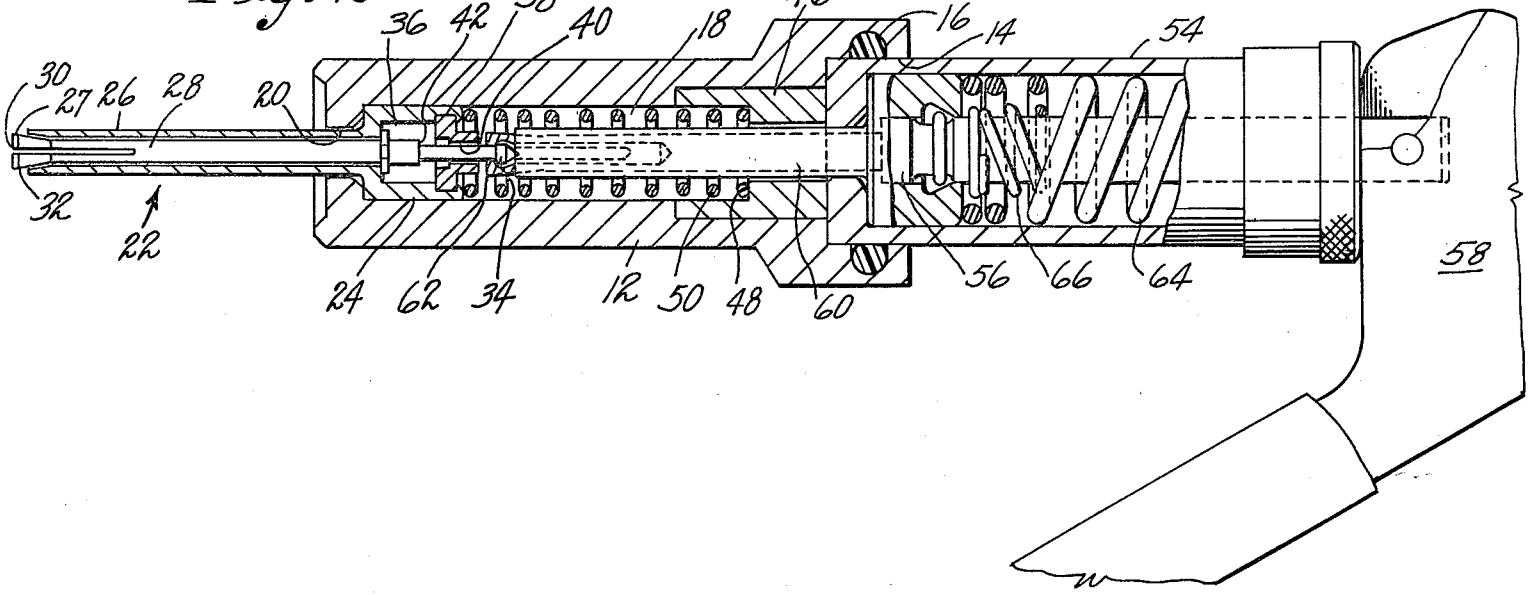
FIG. 2 is a view similar to FIG. 1 showing the adaptor assembled onto the operating mechanism of a tool or "key" of the type adapted for use with plunger locks of the type which have a solid operating pin intended to be grasped externally.
Figure 3:
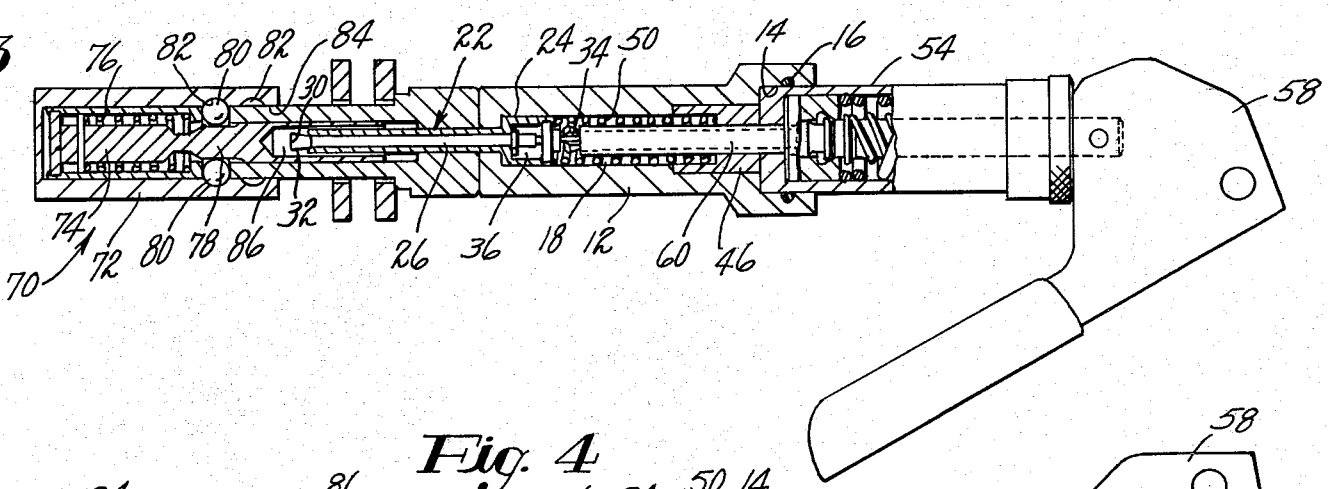
Figure 4:
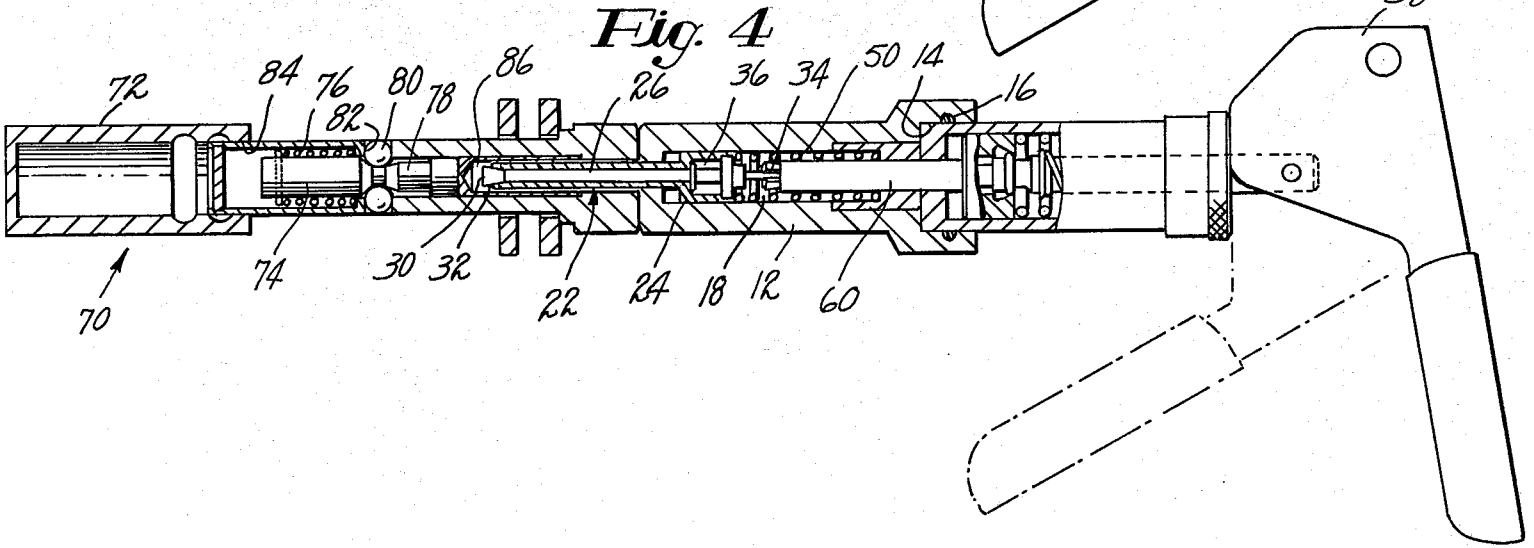
FIG. 4 is a view of a portion of the assembly of FIG. 3 in which the plunger of the lock has been pulled to the unlocking position.

Referring to FIG. 2, the adaptor 10 is shown as assembled onto a tool or "key" 52 of a type adapted for use with a plunger lock of the type having an operating pin intended to be grasped externally and pulled for unlocking, as illustrated in above-mentioned U.S. Pat. No. 4,015,456. The tool 52 comprises a housing 54 through which extends an operating rod 56 connected to an operating handle 58 at the rear of the housing. The rod 56 extends from the forward end of the housing 54 through a tube 60 extending forwardly from the front end of the housing. A pair of flexible jaws 62 are provided on the extreme forward end of the rod 56. The rod is biased forwardly by a spring 64 and the sleeve is biased forwardly by a spring 66.

When the adaptor 10 is assembled onto the forward end of the tool 52 the rear end 34 of the adaptor rod 28 enters between the jaws 62. Thereafter when the handle 58 of the tool is moved toward the position shown by the dotted lines in FIG. 2, the rod 56 is pulled through the housing so that the jaws 62 are forced together by contact of the exterior cam surface 63 of the jaws with the end of the sleeve, thereby causing the jaws to grip the end 34 of the adaptor operating rod 28.

Further rearward movement of the handle 58 to the dotted line position of FIG. 2 causes the sleeve and rod to move into the housing together, pulling the operating rod 28 of the adaptor rearwardly in the manner previously described.

After the adaptor has been assembled onto the tool 52, where it is securely retained by the resilient ring 16, the assembly may be used to unlock a plunger lock 70 of the type having a hollow unlocking member intended to be gripped internally and pulled for unlocking.

The plunger lock 70 may be generally of the type shown in above-mentioned U.S. Pat. No. 3,186,196, comprising a housing 72 having an internal plunger 74 movable axially therein. The plunger is biased to the locking position by spring 76, in which position a plunger portion 78 of predetermined diameter maintains locking balls 80 in an outward position so as to protrude through holes 82 in the housing 72. The housing has an opening 84 at the rear end, and the rear end of the plunger 72 is provided with a cavity 86 to receive the end of an operating tool, such as the end of the operating mechanism 22 of the adaptor 10.

When so inserted into the cavity 86, operation of the handle 58 of the tool 52 causes the operating rod 20 of the adaptor 10 to retract into the end of the sleeve 26, expanding the segments 27 into engagement with the inner surface of the plunger cavity. When the stop 42 on the adaptor rod 28 encounters the bushing 38, further rearward movement of the operating rod (caused by further movement of the handle 58) causes the entire operating mechanism 22 to move rearwardly, pulling the plunger 74 of the lock 70 rearwardly against the force of biasing spring 76 to the unlocking position, where a reduced diameter portion 88 of the plunger 74 is positioned opposite the balls 80, allowing them to retract into the housing and thereby release the lock from whatever article it is attached to.

The construction of the adaptor 10 has the further advantage that if the handle 58 of the tool 52 is operated without the operating mechanism 22 being inserted into the cavity 86 of a plunger lock, the sleeve 26 cannot be damaged, since the head 30 can retract only a predetermined distance into the sleeve 27 because of stop 42, and further movement of the handle cannot damage the stop mechanism, since such further movement only compresses spring 50.

Since certain changes apparent to one skilled in the art can be made in the embodiment of the invention herein illustrated without departing from the scope of the invention, it is intended that all matter contained herein be interpreted in an illustrative and not a limiting sense.

I claim:

1. An adaptor tool for temporary assembly onto a plunger lock unlocking tool of a type having forwardly projecting members which operate to grasp the external surface of the unlocking pin of a plunger lock and pull the pin to the unlocking position, said adaptor tool enabling the unlocking tool to be used to unlock a plunger lock of the type in which the unlocking member is a hollow tube, and comprising a hollow housing having means at the rear end for engaging the front end of the unlocking tool so that the forwardly projecting members extend into the housing, operating means in said housing having a portion positioned for engagement by said members when the tool is operated, said means being spring biased toward the front end of the housing and being movable toward the rear end by the operation of said tool, expandable mechanism projecting from the forward end of the housing for insertion into the hollow unlocking pin of a plunger lock, and means responsive to the movement of said means toward the rear of the housing to cause the expansion of said expandable mechanism and retraction thereof toward the housing.

2. An adaptor tool as set out in claim 1 in which means is provided in the housing which allows the initial rearward movement of said means for engagement by the forwardly projecting members of the tool to cause expansion of said expandable mechanism, and subsequent movement of said means causes retraction of said expandable mechanism into the housing.

3. An adaptor tool, comprising a hollow housing having means on the rear end for frictional assembly onto the front end of a plunger lock operating tool of the type having members that grasp and pull a plunger lock operating pin when the tool is operated, said housing having a retainer slidable axially therein and being spring biased toward the forward end of the housing, said retainer comprising a body portion disposed in the housing and a sleeve projecting from the body and forwardly from the housing, and an operating rod disposed in the retainer, said rod extending through the sleeve and having an enlarged portion positioned just beyond the end of the sleeve, said rod extending rearwardly of the body toward the rear of the housing and terminating in a pin positioned for grasping by the lock operating tool.

4. An adaptor tool as set out in claim 3 in which the end of the sleeve is segmented so that it is radially expandable, and said enlarged portion of the operating rod is shaped to cause radial enlargement of the sleeve when the operating rod moves inwardly in relation to the sleeve.

5. An adaptor tool as set out in claim 4 in which said rod and said retainer have means permitting only limited rearward movement of the rod rearwardly in relation to the retainer, so that when the members of the lock operating tool grasp the pin and pull it rearwardly, on initial rearward movement of the rod, the enlarged end of the rod moves into the sleeve to cause radial enlargement thereof, and thereafter the rod and retainer move rearwardly together to retract the enlarged end of the sleeve toward the housing.

6. An adaptor tool as set out in claim 5 in which said retainer body has an internal cavity and a portion of the operating rod passes through the cavity, a radially extending stop member limiting forward and rearward movement of the rod in relation to the retainer is disposed on the portion of the rod in the cavity.

* * * * *